US006149739A

United States Patent [19]

Smith

[11] Patent Number: 6,149,739

[45] **Date of Patent: *Nov. 21, 2000**

[54] LEAD-FREE COPPER ALLOY

[75] Inventor: Geary Robert Smith, Dyer, Ind.

[73] Assignee: G & W Electric Company, Blue Island, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/812,839

[22] Filed: Mar. 6, 1997

[51] Int. Cl.[7] ..... C22C 9/02

[52] U.S. Cl. ..... 148/433; 420/469; 420/471

[58] Field of Search ..... 420/469, 471; 148/433

[56] References Cited

U.S. PATENT DOCUMENTS

| | | | |
|---|---|---|---|
| Re. 11,660 | 4/1898 | Cothias | 420/517 |
| 952,585 | 3/1910 | Rubel | 420/479 |
| 1,457,289 | 5/1923 | Ostendorf | 420/582 |
| 1,545,838 | 7/1925 | Lehr | 420/473 |
| 1,825,652 | 10/1931 | Buell | 92/47 |
| 1,874,617 | 8/1932 | Price | 420/471 |
| 1,988,938 | 1/1935 | Corson | 420/471 |
| 2,079,411 | 5/1937 | Jennison | 148/434 |
| 2,085,544 | 6/1937 | Price . | |
| 2,101,930 | 12/1937 | Davis | 420/479 |
| 3,079,252 | 2/1963 | Webb et al. | 148/433 |
| 3,134,669 | 5/1964 | de Putter | 420/479 |
| 3,223,913 | 12/1965 | Kalns et al. | 320/163 |
| 3,252,793 | 5/1966 | Hesse | 420/479 |
| 3,297,437 | 1/1967 | Bossman | 420/479 |
| 4,169,729 | 10/1979 | Popplewell et al. | 420/471 |
| 4,202,708 | 5/1980 | Bates et al. | 148/681 |
| 4,242,132 | 12/1980 | Shapiro et al. | 420/479 |
| 4,402,906 | 9/1983 | Ueda et al. | 420/493 |
| 4,589,938 | 5/1986 | Drosdick | 148/435 |
| 4,632,806 | 12/1986 | Morikawa et al. | 420/479 |
| 4,879,094 | 11/1989 | Rushton | 420/476 |
| 5,137,685 | 8/1992 | McDevitt et al. | 420/477 |
| 5,167,726 | 12/1992 | LoIacono et al. | 148/432 |
| 5,242,657 | 9/1993 | Sahu | 420/481 |
| 5,330,712 | 7/1994 | Singh | 420/473 |
| 5,360,591 | 11/1994 | Ruetz et al. | 420/479 |
| 5,409,552 | 4/1995 | McDevitt et al. | 148/434 |
| 5,441,555 | 8/1995 | Matthews et al. | 75/255 |
| 5,487,867 | 1/1996 | Singh | 420/471 |

*Primary Examiner*—Sikyin Ip
*Attorney, Agent, or Firm*—Laff, Whitesel & Saret, Ltd.

[57] ABSTRACT

An improved white manganese bronze alloy containing, in weight percent, about 1.0–3.0 wt % aluminum, about 2.0–4.0 wt % bismuth, about 53–59 wt % copper, about 0.8–2.0 wt % iron, about 11–15 wt % manganese, about 5.0–7.0 wt % nickel, about 1.3–2.5 wt % tin, and about 18–24 wt % zinc, as well as incidental amounts of antimony, lead, phosphorus, silicon and sulfur, which is able to withstand vigorous cleaning and disinfection, and is not subject to galling.

5 Claims, No Drawings

LEAD-FREE COPPER ALLOY

BACKGROUND OF THE INVENTION

This invention generally relates to lead-free machinable alloys and more particularly to a lead-free machinable white manganese bronze alloy which is corrosion-resistant and particularly well-suited for use in food handling equipment.

Copper alloys containing up to five percent by weight lead have been used for many years in constructing equipment for the food industry because they are relatively easy to cast and machine and they withstand the vigorous cleaning to which equipment is subjected in such industries. For example, in the processing of chicken and other meats, the food handling equipment must be cleaned and disinfected daily with bleach solutions. Bleach has a high concentration of chlorine, which is a strong oxidizing agent and therefore very corrosive to aluminum and somewhat corrosive to copper, both of which are found in alloys otherwise desirable for such applications. In the past, the introduction of lead into such aluminum and copper-containing alloys was found to give the alloys a lubricating quality which reduced friction at points in which there was metal-to-metal contact.

Unfortunately, it has now been established that ingestion of even small amounts of lead by human beings can cause health problems. Therefore, it is important to minimize the possibility of introducing lead into foods by eliminating all lead in metal alloys that come in contact with food. Also, when lead-containing alloys are machined, the machine turnings as well as spent lubricants will contain high concentrations of lead. These manufacturing by-products present a danger of environmental pollution and therefore should be eliminated if possible. Indeed, even the casting of lead-based alloys is undesirable since lead vapor released during the casting process can enter into the atmosphere.

Various attempts have been made to provide a lead-free alloy for use in food handling equipment and other applications. Unfortunately, such prior alloys have been undesirable for a number of reasons including shrinkage in casting and increased liquidus and pouring temperatures.

SUMMARY OF THE INVENTION

The improved white manganese bronze alloy of the present invention is lead-free, yet overcomes the problems associated with prior lead-free alloys including good lubricity, that is, the ability to move upon itself or stainless steel without significant galling. This new alloy, which may be described as a white manganese bronze, contains the following elements, in the weight percentages indicated:

| Element | Weight Percent |
|---|---|
| aluminum | 1.0–3.0 |
| bismuth | 2.0–4.0 |
| copper | 53–59 |
| iron | .8–2.0 |
| manganese | 11–15 |
| nickel | 5.0–7.0 |
| tin | 1.3–2.5 |
| zinc | 18–24 |

Additionally, the new alloy of this invention may contain small amounts of antimony, lead, phosphorus, silicon and sulfur as incidental or trace elements. These incidental or trace elements are impurities inherent in the copper used in the alloy, as recognized by those skilled in the art. For example, in Section 1.4 of this ASTM Designation B224-96 entitled "Standard Classification of Coppers" it is explained that in general usage in the trade, copper is specified as 99.85% or more and that the balance may include other elements. ASTM Designation B170-93, entitled "Standard Specification for Oxygen, Free Electrolytic Copper-Refinery Shapes", explains that Grade 1 copper under that specification may include the following maximum levels of antimony, lead, phosphorus and sulfur:

Antimony 4ppm

Lead 5ppm

Phosphorus 3ppm

Suflur 15ppm.

In a preferred embodiment, the improved white manganese bronze alloy contains the following elements, in the weight percentages indicated:

| Element | Weight Percent |
|---|---|
| aluminum | 1.1 |
| bismuth | 2.2 |
| copper | 55.5 |
| iron | 1.0 |
| manganese | 12.0 |
| nickel | 5.5 |
| tin | 1.7 |
| zinc | 21 |

DESCRIPTION OF THE PREFERRED EMBODIMENTS

The preparation of alloys in accordance with the invention as well as the characteristics of the alloys produced are described in the examples which follow. These examples, which establish the superiority of the present invention, are intended to illustrate the present invention and to teach one of ordinary skill in the art how to make and use the invention. These examples are not intended to limit the invention or its protection in any way.

EXAMPLE 1

1. A white manganese bronze alloy was prepared in accordance with the present invention using an electric induction furnace to melt down and combine the following elements:

| Element | Weight Percent |
|---|---|
| aluminum | 1.0–3.0 |
| bismuth | 2.0–4.0 |
| copper | 53–59 |
| iron | .8–2.0 |
| manganese | 11–15 |
| nickel | 5.0–7 |
| tin | 1.3–2.5 |
| zinc | 18–24 |

Copper and nickel were charged to the bottom of the melting vessel followed by iron and manganese. When the charge began melting, bismuth and tin were added, and heating was continued until the charge was completely molten. Before reaching the desired pouring temperature, the aluminum and zinc were added. The melt was then tapped into a pouring vessel and poured into molds to cast parts of the desired shape and size.

EXAMPLE 2

The characteristics of the alloy of the present invention were compared to a commercially available lead-containing alloy, known as "White Tombasil" as well as a commercial alloy believed to be made in accordance with the teaching of U.S. Pat. No. 5,242,657, sold under the trademark "Modified 119 WM" by Waukesha Foundry, Inc. of Waukesha, Wis. The tensile strength, yield strength, percent elongation and Brinnell hardness of the materials were tested by conventional means, with results as reported below.

| Elements | White Tombasil | '657 Material | Alloy of Example 1 |
|---|---|---|---|
| aluminum | 0.6–0.9 | 0 | 1.1/1.0/1.4 |
| bismuth | | 4.0 | 2.2/2.0/2.5 |
| copper | 58.0 | 64 | 55/53/59 |
| iron | 1.0 max | 1.5 | 1.0/0.8/1.2 |
| lead | 1.5–2.0 | 0 | 0 |
| manganese | 12.0 | 0 | 12/11/14 |
| nickel | 5.0 | 22 | 6.0/5.0/6.5 |
| tin | | 4.5 | 1/7/1.3/2.0 |
| zinc | 22.0 | 4.0 | 21/18/24 |

| Test | White Tombasil[1] | '657 Material | Alloy of Example 1 |
|---|---|---|---|
| tensile strength | 55,000–65,000 | 26,000 psi | 55,000 psi |
| yield strength | 25,000–28,000 | 24,000 psi | 30,000 psi |
| % elongation | 10–20 | 2.5 | 13 |
| Brinnell Hardness | 110–125 | 120 | 130 |

[1]As reported by manufacturer, H. Kramer and Co. of El Segundo, California

EXAMPLE 3

Galling tests were conducted in metal-to-metal contact of the alloy of Example 1 with 316 stainless steel using a Multi-Specimen (Model 6) machine to perform an ASTM D3702 Small Thrust Washer test. The test parameters were as follows:

| TEST PARAMETERS: | |
|---|---|
| SPEED (rpm): 90 | DURATION (min): 5 per stage |
| TEMP (° C.): Ambient | LOAD (lbs): 20 + 10/5 min- 200 |
| LOWER STATIONARY RING: | |
| MATERIAL: 316 S.S. | HARDNESS (HRc): Annexed |
| FALEX TL#: 8253 | SUR. FIN. (rms): 14–18 |

The following data was generated in this test:

COEFFICIENT OF FRICTION DATA:

| Uppr TL | | | |
|---|---|---|---|
| Load: (lbs) | CoF: (avg) | Load: (lbs) | CoF: (avg) |
| 20 | 0.078 | 110 | 0.392 |
| 30 | 0.259 | 120 | 0.394 |
| 40 | 0.392 | 130 | 0.409 |
| 50 | 0.612 | 140 | 0.407 |
| 60 | 0.600 | 150 | 0.406 |

-continued

| Uppr TL | | | |
|---|---|---|---|
| Load: (lbs) | CoF: (avg) | Load: (lbs) | CoF: (avg) |
| 70 | 0.543 | 160 | 0.410 |
| 80 | 0.439 | 170 | 0.445 |
| 90 | 0.390 | 180 | 0.477 |
| 100 | 0.367 | 190 | 0.442 |
| | | 200 | 0.571 |

| Uppr ID Appearance | | |
|---|---|---|
| Load | Upper (Example 1) | Lower (316 S.S.) |
| 20 | High spots lightly worn. | Very light scuffing |
| 30 | Same | Same |
| 40 | Same | Same, light material transfer |
| 50 | Same, very light scoring | Same, wear track widened |
| 60 | Same | Same, very light scoring |
| 70 | Same, 35% contact | Same |
| 80 | Unchanged | Scoring on inside wear track |
| 90 | Light pitting, 40% contact | Light scoring, no material transfer |
| 100 | Same | Same |
| 110 | Same | Same |
| 120 | Very light galling | Unchanged |
| 130 | Same | Same |
| 140 | Light galling | Light scoring |
| 150 | Same | Wear track fully developed |
| 160 | Same | Medium scoring |
| 170 | Unchanged | Unchanged |
| 180 | Medium galling, 60% contact | Same |
| 190 | Same, 70% contact | Deeper scoring |
| 200 | Same, 80% contact | |

The test establishes that until a load of at least 150 lbs. is applied, no significant metal transfer or scoring is experienced with metal-to-metal contact between the alloy of the present invention and 316 stainless steel.

EXAMPLE 4

The white manganese bronze alloy of Example 1 was compared in the field to a standard leaded alloy (C99700) in terms of pour temperature, fluidity, and casting defects.

It was found that the new alloy could be poured at a temperature approximately 50° F. lower than the standard and that the new alloy exhibited slightly better fluidity. The new alloy was easier to pour through ceramic filters and, on casting, produced significantly fewer incomplete casting defects in comparison to the standard leaded alloy. Additionally, it was found that the new alloy did not shrink as much as the prior leaded alloy, making it possible to use risers as much as 25% smaller than used previously, without producing shrinkage defects in the castings. Indeed, it was observed that the new alloy shrinks in a more uniform manner; instead of producing a deep piping effect in the center of the riser that might migrate to the casting, the new alloy shrinks uniformly against the entire riser. The absence of deep piping resulted in no shrinkage defects at the ingate of the casting.

While the present invention is described above in connection with preferred or illustrative embodiments, those embodiments are not intended to be exhaustive or limiting of the invention. Rather, the invention is intended to cover all alternatives, modifications and equivalents that may be included within its sphere and scope, as defined by the appended claims.

What is claimed is:

1. An improved white manganese bronze alloy consisting essentially of, in weight percent, about 1.0–3.0 wt % aluminum, about 2.0–4.0 wt % bismuth, about 53–59 wt % copper, about 0.8–2.0 wt % iron, about 11–15 wt % manganese, about 5.0–7.0 wt % nickel, about 1.3–2.5 wt % tin, and about 18–24 wt % zinc, as well as incidental amounts of impurities, which is able to withstand vigorous cleaning and disinfection, and is not subject to galling.

2. The improved white manganese bronze alloy of claim 1 comprising, in weight percent, about 1.1 wt % aluminum, about 2.2 wt % bismuth, about 55.5 wt % copper, about 1.0 wt % iron, about 12 wt % manganese, about 5.5 wt % nickel, about 1.7 wt % tin, and about 21 wt % zinc.

3. In a machine containing at least two opposed metal members in contact with one another and arranged for movement in relation to each other, at least one of said members fabricated of a white manganese bronze alloy consisting essentially of about 1.0–3.0 wt % aluminum, about 2.0–4.0 wt % bismuth, about 53–39 wt % copper, about 0.8–2.0 wt % iron, about 11–15 wt % manganese, about 5.0–7.0 wt % nickel, about 1.3–2.5 wt % tin, and about 18–24 wt % zinc, which is able to withstand vigorous cleaning and disinfection, and is not subject to galling.

4. In the machine of claim 3, in which one of the opposed members is made of stainless steel.

5. An improved white manganese bronze alloy comprising in weight percent, about 1.0–3.0 wt % aluminum, about 2.0–4.0 wt % bismuth, about 53–59 wt % copper, about 0.8–2.0 wt % iron, about 11–15 wt % manganese, about 5.0–7.0 wt % nickel, about 1.3–2.5 wt % tin, and about 18–24 wt % zinc, which is able to withstand vigorous cleaning and disinfection, and is not subject to galling.

* * * * *